US007743836B2

(12) United States Patent
Cook et al.

(10) Patent No.: US 7,743,836 B2
(45) **Date of Patent: *Jun. 29, 2010**

(54) APPARATUS FOR CONTROLLING SLIP DEPLOYMENT IN A DOWNHOLE DEVICE AND METHOD OF USE

(76) Inventors: Robert Bradley Cook, 304 Scotchpine Dr., Mandeville, LA (US) 70448; Glenn Mitchell Walls, 112 Normandy Dr., Folsom, LA (US) 70437

( * ) Notice: Subject to any disclaimer, the term of this patent is extended or adjusted under 35 U.S.C. 154(b) by 34 days.

This patent is subject to a terminal disclaimer.

(21) Appl. No.: 12/369,399

(22) Filed: Feb. 11, 2009

(65) Prior Publication Data

US 2009/0145614 A1 Jun. 11, 2009

Related U.S. Application Data

(63) Continuation of application No. 11/525,350, filed on Sep. 22, 2006, now Pat. No. 7,578,353.

(51) Int. Cl.
*E21B 23/06* (2006.01)

(52) U.S. Cl. ..... 166/387; 166/134

(58) Field of Classification Search ..... 166/387, 166/138, 140, 134, 118
See application file for complete search history.

(56) References Cited

U.S. PATENT DOCUMENTS 2,217,747 A 10/1940 Henderson
5,701,959 A 12/1997 Hushbeck et al.
6,695,051 B2 2/2004 Smith et al.
6,827,150 B2 12/2004 Luke
7,475,736 B2 * 1/2009 Lehr et al. ..... 166/386

* cited by examiner

*Primary Examiner*—David J Bagnell
*Assistant Examiner*—David Andrews
(74) *Attorney, Agent, or Firm*—Jones Walker

(57) ABSTRACT

An apparatus for use in a well. The apparatus comprises a mandrel containing a radial shoulder, a sub member concentrically disposed about the mandrel, and an upper slip, concentrically disposed about the mandrel, for engaging the well. The apparatus further comprises an upper cone abutting an underside of the upper slip, and wherein the upper cone is disposed about the mandrel, and an elastomer operatively associated with the upper cone, and wherein the elastomer is disposed about the mandrel. The apparatus further includes a lower slip, concentrically disposed about the mandrel, for engaging with the internal portion of the well, and lower cone abutting an underside of the lower slip, and wherein the lower cone is disposed about the mandrel, and wherein the lower cone is operatively associated with the elastomer. The apparatus further contains a first alignment member selectively connecting the sub with the upper slip, and wherein the first alignment pin is selected to shear at a first predetermined force.

29 Claims, 8 Drawing Sheets

APPARATUS FOR CONTROLLING SLIP DEPLOYMENT IN A DOWNHOLE DEVICE AND METHOD OF USE

CROSS-REFERENCE TO RELATED APPLICATIONS

This application is a continuation of and claims priority to U.S. patent application Ser. No. 11/525,350, filed on Sep. 22, 2006.

FIELD OF THE INVENTION

The present invention relates to a downhole apparatus and method, including a packer apparatus. More particularly, but not by way of limitation, this invention relates to an apparatus and method for controlling the extension and deployment of slips in a well packing device.

BACKGROUND OF THE INVENTION

Generally in the prior art, well bore packing devices, commonly known as cast-iron bridge plugs/packers, use one-piece slip assemblies as a means to anchor the packing device to the tubular member of the well to be sealed off. The slip assembly is critical to the success of the packing device anchoring in place and maintaining well control. Various problems are encountered with the prior art in deployment of prior art slips, some of which may lead to a failure of the packer to anchor and seal.

Prior art slips may have a tapered inner diameter. There is usually a series of cuts or reduced wall thickness areas evenly spaced around the circumference of the slip assembly to predispose the slip assembly to fracture into multiple segments when compressed against the mating inner diameter taper of a cone run congruent to the slip on the center mandrel of the tool assembly.

As those of ordinary skill in the art will recognize, a potential problem with the prior art arrangement is that not all segments must fracture for the slip to deploy and there is no assurance that any symmetrical spacing around the circumference of the packing device is maintained. This can lead to the packing device being slightly offset from the centerline of the tubular member to be sealed off. The compression of the slip against the cone causes the slip to separate into pieces and wedge between the cone and the inner diameter of the tubular member. If the slip assembly is not anchored in any way to the cone or to the body of the plug assembly, the slip segments are subject to non-aligned irregular contact against the inner diameter of the tubular member (e.g. a slip segment may rotate off axis with the tubular).

This problem is made worse in the actual setting dynamic by the sudden movement (relief) that takes place when the slip which is subjected to the force required to break the segments is no longer retained on the plug mandrel, in a sense, the slip segments accelerate away from the mandrel independent of the movement of the cone. This restricts the plug to being used in a tubular member with an inner diameter close to the diameter of the plug. As the annular space increases between the plug and the tubular inner diameter, the potential for irregular slip deployment is higher. Thus, this problem prevents the one piece segmented assembly from being used in applications with high expansion ratio over the original diameter of the un-segmented slip.

In the setting operation of the prior art slips, the upper set of slips normally sets first and the slips on the lower (or opposite) end then deploy and are dragged up the inner diameter of the pipe in which the plug is being set during the final compression of the elastomer. This creates friction/drag that must be overcome by force from the setting tool. The setting tool releases the plug when a predetermined force is achieved. Excessive drag may cause release of the plug from the setting tool before optimum compression of the elastomer is achieved thus possibly reducing the effectiveness of the elastomer seal.

Therefore, the present invention solves these problems associated with the prior art. An object of the disclosed apparatus and method is that the slips deploy in a relatively even manner around the circumference of the well packing device. Another object of the present disclosure is that the device controls the timing of deployment thereby controlling the load transfer into the packing element during deployment. Yet another object is that the present apparatus controls the setting range in which the slips can function properly. Still yet another object is that the present disclosure allows for a higher deployment diameter for slip extension when compared to prior art packers.

SUMMARY OF THE INVENTION

A downhole apparatus for use in a well is disclosed. The apparatus comprises a mandrel containing a radial shoulder, a first sub member concentrically disposed about the mandrel, and an upper slip means, concentrically disposed about the mandrel, for engaging with an internal portion of the well. The apparatus further comprises an upper cone means abutting an underside of the upper slip means, and wherein the upper cone means is disposed about the mandrel, and an elastomeric member operatively associated with the upper cone means, and wherein the elastomeric member is disposed about the mandrel.

The apparatus further includes a lower slip means, concentrically disposed about the mandrel, for engaging with the internal portion of the well, and lower cone means abutting an underside of the lower slip means, and wherein the lower cone means is disposed about the mandrel, and wherein the lower cone means is operatively associated with the elastomeric member. The apparatus further contains a first alignment member selectively connecting the first sub member with the upper slip means, and wherein the first alignment pin is selected to shear at a first predetermined force. The apparatus may further comprise a stroke limiter means, selectively attached to the mandrel, for allowing a predetermined amount of force to set the elastomeric member.

In one preferred embodiment, the upper slip means comprises a plurality of radial teeth and a series of longitudinal grooves formed thereon, and the lower slip means may also comprise a plurality of radial teeth and a series of longitudinal grooves formed thereon. In one preferred embodiment, the stroke limiter means comprises a lower cone leg member concentrically disposed about the mandrel, a longitudinal slot in the lower cone leg member, a second sub member having a lip and wherein a first end of the lower cone leg member is engaged with the lip, and a shear pin selectively attaching the lower cone leg member to the mandrel, and wherein the shear pin is positioned through the longitudinal slot.

In one preferred embodiment, the upper slip means has a first tapered angle on a first end, and the lower slip means has a second tapered angle on a second end. Also, the apparatus may include a second alignment member selectively connecting said radial shoulder with said lower slip means, wherein said second alignment member is selected to shear at a second predetermined force. The apparatus may also include a setting tool means for imparting a force in a first direction that is transmitted to said mandrel so that said upper cone means travels in the first direction, which in turn causes said radial shoulder to travel in a first direction which in turn expands said upper slip device.

As per the teachings of the present invention, the first and second tapered angle is between 10 degrees and 45 degrees. Also, the first and second alignment member is a pin having a predetermined shear value.

Also disclosed is a method of setting a packer in a well. The method includes providing the packer on a work string (which may be coiled tubing, wireline, drill string, production string, tubular, etc.) in the well, wherein the packer comprises: a mandrel having a radial shoulder; an upper slip, concentrically disposed about the mandrel, for engaging with an internal portion of the well; an upper cone abutting an underside of the upper slip, the upper cone disposed about the mandrel; an elastomeric member operatively associated with the upper cone, and wherein the elastomeric member is disposed about the mandrel; a lower slip, concentrically disposed about the mandrel, for engaging with the internal portion of the well; a lower cone abutting an underside of the lower slip, the lower cone disposed about the mandrel, and wherein the lower cone is operatively associated with the elastomeric member; a first alignment member selectively connecting a sub member with the upper slip, wherein the first alignment member is selected to shear at a first predetermined force; and a stroke limiter means, selectively attached to the mandrel, for allowing a predetermined amount of force to be applied to the elastomeric member.

The method further comprises moving the mandrel in a first direction, engaging the upper cone against an underside of the upper slip, and fracturing the upper slip along the series of longitudinal grooves within the upper slip.

The method further includes opening the upper slip in a controlled mode, opening the lower slip in a controlled mode, shearing the upper alignment pin, and anchoring the upper slip against the internal portion of the well. The method further comprises compressing the elastomeric member so that the elastomeric member engages the internal portion of the well, shearing the shear pin in the stroke limiter means, and anchoring the lower slip against the internal portion of the well.

In one preferred embodiment, the upper and lower slips contain tapered angles so that upon deployment a set of teeth of the upper and lower slips engage the internal portion of the well only upon full engagement with the upper and lower cone. Also, in one preferred embodiment, the first and second alignment members are pins having predetermined shear values.

An advantage of the present disclosure is that the downhole tool can be efficiently and economically manufactured. Another advantage is the slip design utilizes a one-piece cast iron construction, although it is within the teachings of the present disclosure that the slips may already be segmented. Each segment that is created by the fracturing of the slip against the cone and is accomplished by the placement of cuts or reduced wall areas in uniform manner around the circumference of the slip. Yet another advantage is that alignment shear pins are placed in the slip, and wherein the shear pins extend from the plug body into the slip body (one shear pin per segment) to keep the slip segments in place (aligned) relative to the inner mandrel and cone until the extension is required.

Another advantage is that the compression of the cone into the internal portion of the slip causes the slip to ride up the angle of the cone and the force generated causes the one-piece slip to fracture into segments. Each segment is then held in relative alignment by the alignment shear pin. Further compression moves the cone further into the slip body causing further expansion until the slip reaches the proposed setting internal diameter.

A feature of the present invention is the tapered end of the slip. The teeth that cause the slips to bite into the wall of the tubular do not come into contact with the tubular inner portion until a minimum diameter is reached. This feature is advantageous when running through a small tubular to get to the intended setting area of larger diameter. Emergency removal of a plug in an inner portion too small for the slip to engage is easily accomplished when the slips are not anchored to the tubular.

Another feature is that the tapered end also allows for higher expansion ratios for the plug i.e. the tool outer diameter before being set versus the tool outer diameter after being set. The final setting diameter can be a much higher ratio relative to the plug running diameter than with the prior art packers. The higher expansion ratio is further assisted by the presence of a radius lower end (i.e. curved end) of the slip that allows the slip to deploy in a rocker fashion rather than sliding, as done in the prior art, from one outer diameter to the next outer diameter.

In the process of setting the plug, a feature of the present invention is that the elastomer is energized to a minimal value to ensure the effectiveness of the seal. This feature is accomplished by the placement of a stroke limiter means to prevent the lower cone from expanding the slips to the setting inner diameter and creating drag before a minimal force amount can be imparted to the elastomer. Another feature is that the stroke controller includes a shear pinned ring on a mandrel that allows a small amount of stroke (relative movement) to partially open the slips, but the pins must shear before additional stroke can be imparted to the cone. The pins are pre-set for the minimal value of force (9,600 lbs in the most preferred embodiment) to be imparted to the elastomer. This could also be accomplished by means other than shear pins; for instance, it could be a tensile member that separates, a frangible spacer material that crushes, or a spring (or springs) that compresses.

DETAILED DESCRIPTION OF PREFERRED EMBODIMENTS

Figure 1A:
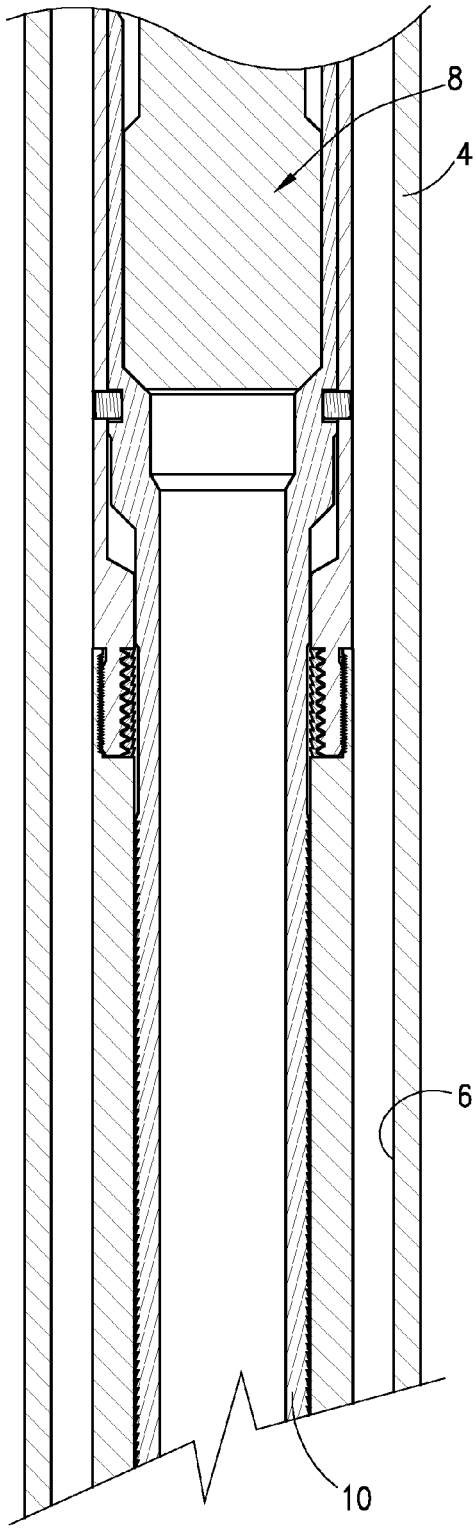
FIGS. 1A, 1B, and 1C depict the most preferred embodiment of the present invention in the run-in mode.
Figure 1B:
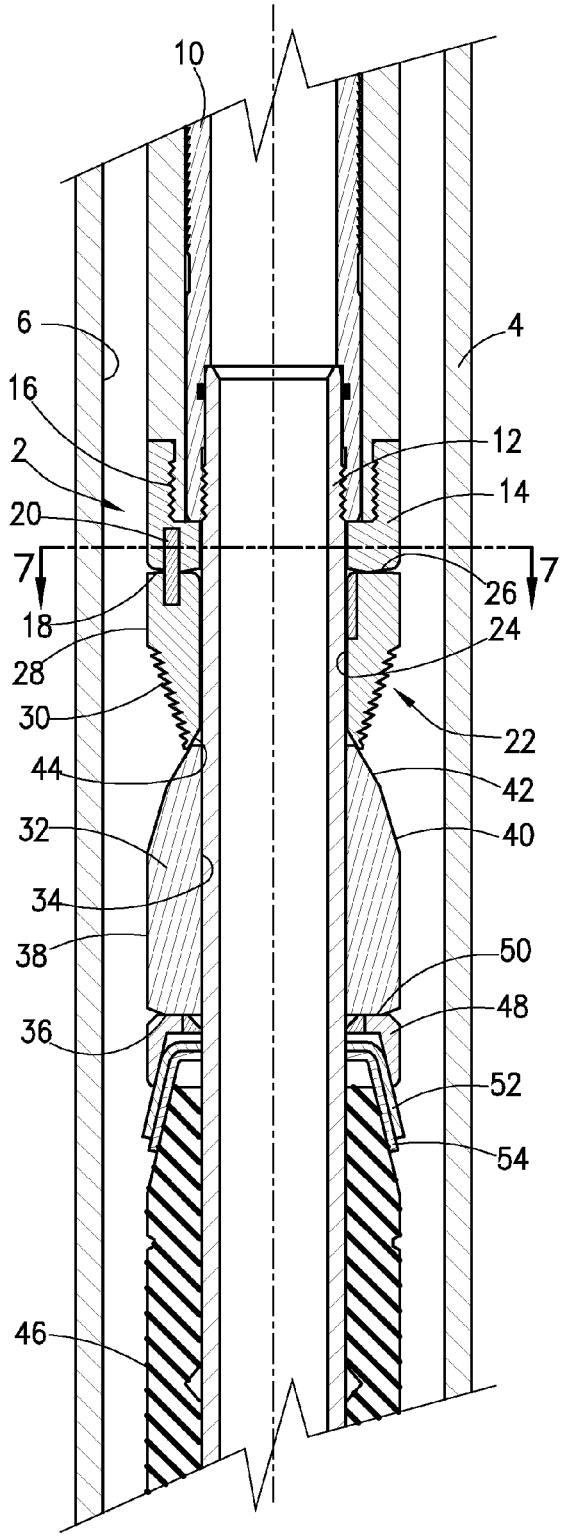
Figure 1C:
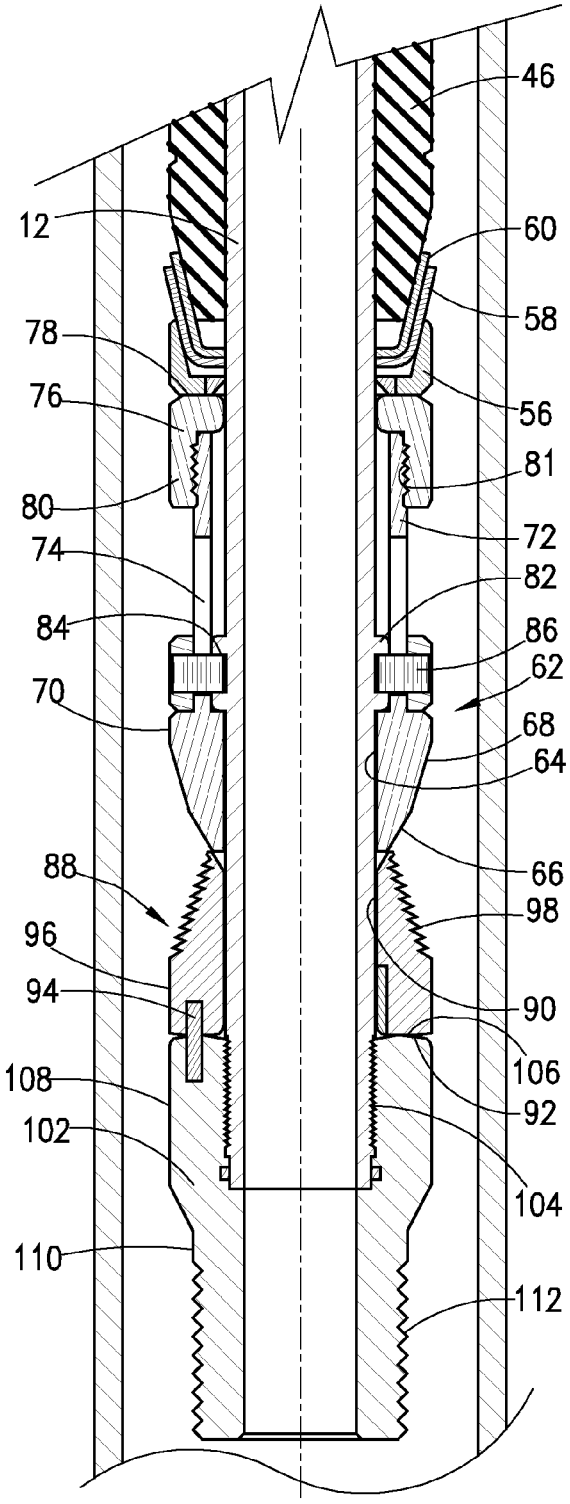

Referring now to FIGS. 1A, 1B, and 1C, the most preferred embodiment of the present invention in the run-in mode will now be described. More specifically, the apparatus 2 is shown disposed within a well 4, and wherein the well 4 may be referred to as a casing string 4. The well 4 has an inner diameter portion 6. As those of ordinary skill in the art will recognize, the apparatus 2 is operatively associated with a setting tool means 8 for setting the apparatus 2. Setting tool means may be hydraulically activated, mechanically activated, explosively activated, or electrically activated. In the most preferred embodiment, the setting tool means 8 used with the apparatus 2 will be electrically activated. Setting tool means of this type are commercially available from Owen Oil Tools Inc. under the name Wireline Pressure Setting Tool.

The setting tool means 8 is operatively attached with a power mandrel 10 that is threadedly attached to the inner mandrel 12 of the apparatus 2. The apparatus 2 also includes the sub 14. The sub 14 is concentrically disposed about the mandrel 12, and the sub 14 contains a radial face 18 that will have a hole disposed therein for placement of an alignment pin 20. As shown in FIG. 1B, radial face 18 has a curved surface to aid the rocking movement when the slips are deployed. FIG. 1B also depicts the upper slip device, seen generally at 22. The upper slip device 22 is generally a cylindrical member that is concentrically disposed about the mandrel 12. The upper slip device 22 has a series of longitudinal grooves or cuts disposed on its outer surface so that when the upper slip device 22 fractures, the slip 22 will fracture into separate and equivalent segments. The upper slip device 22 will have an inner diameter portion 24 which extends to the radial face 26, and wherein the radial face 26 will have a hole for placement of the alignment pin 20. The upper slip device 22 has an outer cylindrical surface 28 that extends to the tapered surface 30, and wherein the tapered surface 30 contains a plurality of radial teeth for engagement with the inner diameter portion 6. The angle of the taper will range from 10 to 45 degrees, and in the most preferred embodiment, the taper will be 20 degrees.

The apparatus 2 will also include the upper cone means 32 that contains an inner diameter portion 34 that extends to the radial end surface 36. The upper cone means 32 has an outer diameter surface 38 that extends to a first angled surface 40 and a second angled surface 42 for cooperation with the angled surface 44 of the upper slip device 22. FIG. 1A also depicts the elastomeric member 46, sometimes referred to as the elastomer means 46, which in operation will be expanded in order to engage and seal with the inner diameter portion 6, as is well understood by those of ordinary skill in the art. The elastomeric member 46 is commercially available from MP Industries Inc. under the name HSN.

FIG. 1B shows a series of cups that cooperate and engage with one end of the elastomeric member 46. More specifically, FIG. 1B depicts the metal cup 48, wherein the radial end 50 abuts the radial end surface 36. The opened end of the cup 48 abuts the metal cup 52, as well as metal cup 54, and wherein cups 48, 52, 54 are flexible in order to give partial way when the elastomeric member 46 is expanded i.e. the cups 48, 52, 54 open-up when the elastomeric member 46 expands and prevents elastomer extrusion into the annular space, and wherein the cups 48, 52, 54 act to control and guide the expansion of the elastomeric member 46. It should be noted that other materials besides metals could be used.

FIG. 1C depicts a second set of cups that cooperate and engage with the elastomeric member 46. More specifically, a metal cup 56 has an opened end that receives the metal cup 58 and wherein the metal cup 58 receives the metal cup 60. The cups 56, 58 and 60 are flexible, and are similar to the cups 48, 52, 54. The open end of cup 60 receives and cooperates with the end of elastomeric member 46. The cups 56, 58, 60 open-up when the elastomeric member 46 expands, and wherein the cups 56, 58, 60 act to control and guide the expansion of the member 46, and prevents elastomer extrusion into the annular area.

The lower cone means is seen generally at 62, and wherein the lower cone means is concentrically disposed about the mandrel 12. The lower cone means 62 has an inner diameter portion 64 that extends to the first outer angled surface 66, which in turn extends to the second outer angled surface 68, which in turn stretches to the third outer surface 70. The third outer surface 70 has extending therefrom the lower cone leg member 72, and wherein the lower cone leg member 72 is generally a cylindrical member having a longitudinal slot 74. FIG. 1C also shows the sub member 76 which is concentrically disposed about the mandrel 12, with the sub member 76 having a radial face 78 that abuts the cup 56, and wherein the sub member 76 also contains the lip 80, and wherein the lip is generally tubular in shape. The lip 80 contains internal threads that will engage with external threads on the lower cone leg member 72, as seen at 81.

As shown in FIG. 1C, the inner mandrel 12 has a raised portion 82 (wherein the raised portion 82 is an area of greater wall thickness) that has a hole 84 therein, and wherein a shear pin 86 is placed through the slot 74 and into the hole 84. In this way, the stroke limiter means generally comprises the lower cone leg member 72 concentrically disposed about the mandrel 12, the sub member 76, and the shear pin 86 selectively attaching the lower cone leg member 72 to the mandrel 12. The shear pin 86 is disposed within hole 84 of the raised portion 82.

The lower slip device 88 is similar in construction to the upper slip device 22. The lower slip device 88 has a series of longitudinal grooves or cuts disposed on its outer surface so that when the lower slip device 88 fractures, the slip will fracture into separate and equivalent segments. The lower slip device 88 will have an inner diameter portion 90 which extends to the radial face 92, and wherein the radial face 92 will have a hole for placement of the alignment pin 94. As shown in FIG. 1C, radial face 92 has a curved surface to aid the rocking movement when the slips are deployed. The lower slip device 88 has an outer cylindrical surface 96 that extends to the tapered surface 98, and wherein the tapered surface 98 contains a plurality of radial teeth for engagement with the inner diameter portion 6. The angle of the taper will range from 10 to 45 degrees, and in the most preferred embodiment, the taper will be 20 degrees.

FIG. 1C further depicts the lower member 102 that is threadedly attached to the mandrel 12 via internal thread means 104, and therefore, is an extension of the mandrel 12. The lower member 102 is generally a cylindrical member that has a radial face 106, and wherein the radial face 106 contains a hole for cooperation with the alignment pin 94. The lower member 102 has a first outer diameter surface 108 that extends to the second outer diameter surface 110 that contains outer thread means 112 for engagement with a bottom hole assembly (not shown).

Figure 2A:
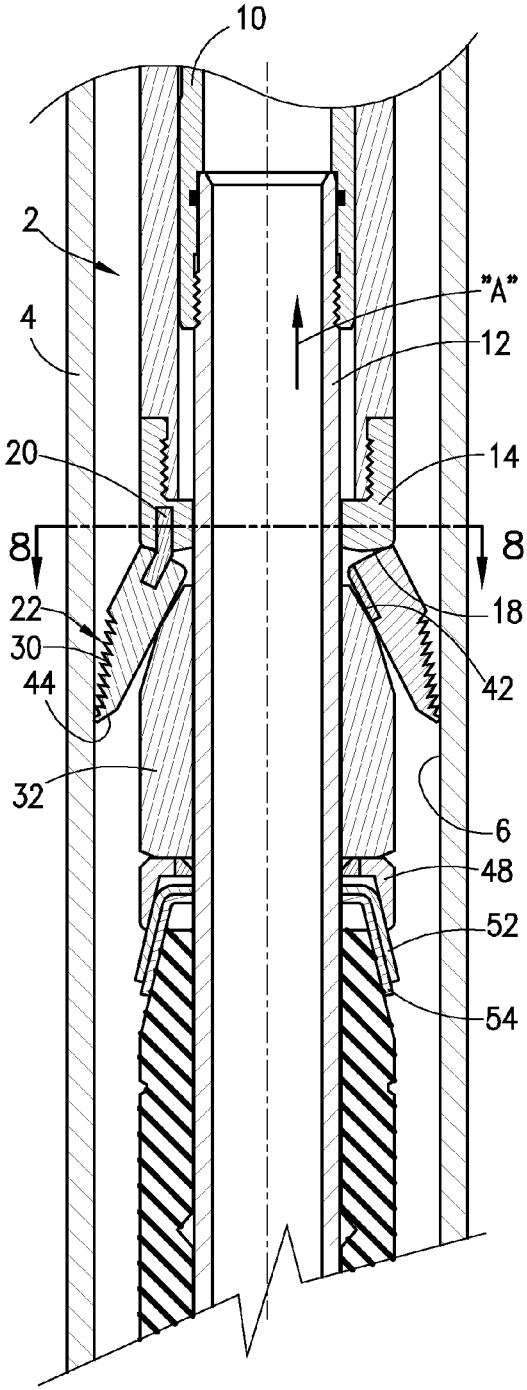
FIGS. 2A and 2B depict the embodiment seen in FIGS. 1A, 1B, and 1C with the upper slips in the controlled open mode.
Figure 2B:
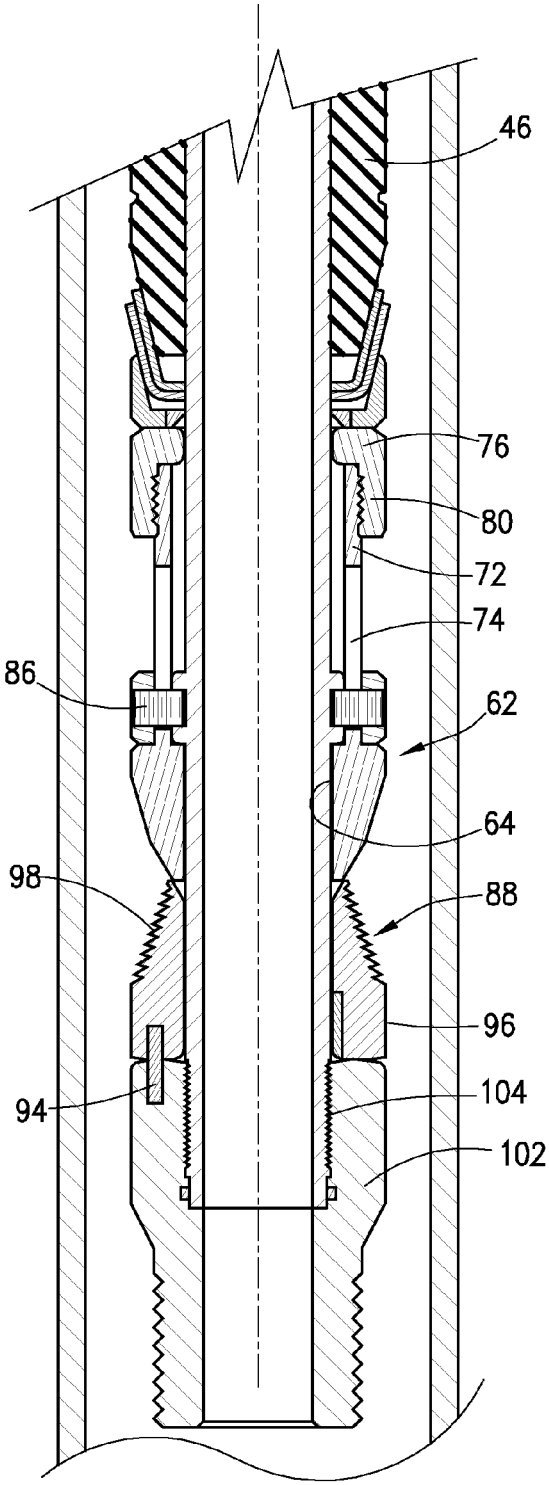

Referring now to FIGS. 2A and 2B, the embodiment of the present apparatus 2 seen in FIGS. 1A and 1B will be described with the upper slip device 22 in the controlled open mode. It should be noted that like numbers appearing in the various figures refer to like components. In this embodiment, the setting tool means 8 has caused the lateral movement of the power mandrel 10 (not seen in this view), which in turn causes the inner mandrel 12 to move in the longitudinal direction shown by arrow "A". This movement will also cause the lower member 102 to move in a like manner. This movement will cause the upper cone means 32 to move upward, as shown in FIG. 2A, so that the upper slip device 22 will begin expanding due to the upper cone means 32 wedging effect. This expansion will cause the upper slip device 22 to crack along the pre-cut lateral grooves, as noted earlier. The continued outward expansion will allow the angled surface 44 to engage against the inner diameter portion 6.

As shown in FIG. 2A the alignment pin 20 is beginning to bend, but has not sheared, which allows equal radial expansion of the upper slip device 22. As will be discussed in greater detail later in the disclosure, a plurality of alignment pins will be placed about radial face 18. The radial face 18 has the curved surface to aid in the rocker motion which provides a smoother, steady, and gradual force to be applied to the alignment pin 20. FIG. 21 depicts the alignment pin 94 that has not, at this point in the process, undergone any stress forces and is still in the pinned position. Hence, the lower cone means 62 has not moved, which in turn means that the lower slip device 88 has also not moved. Alignment pins control phasing of the tapered slips so when opening, they go out evenly.

Figure 3A:
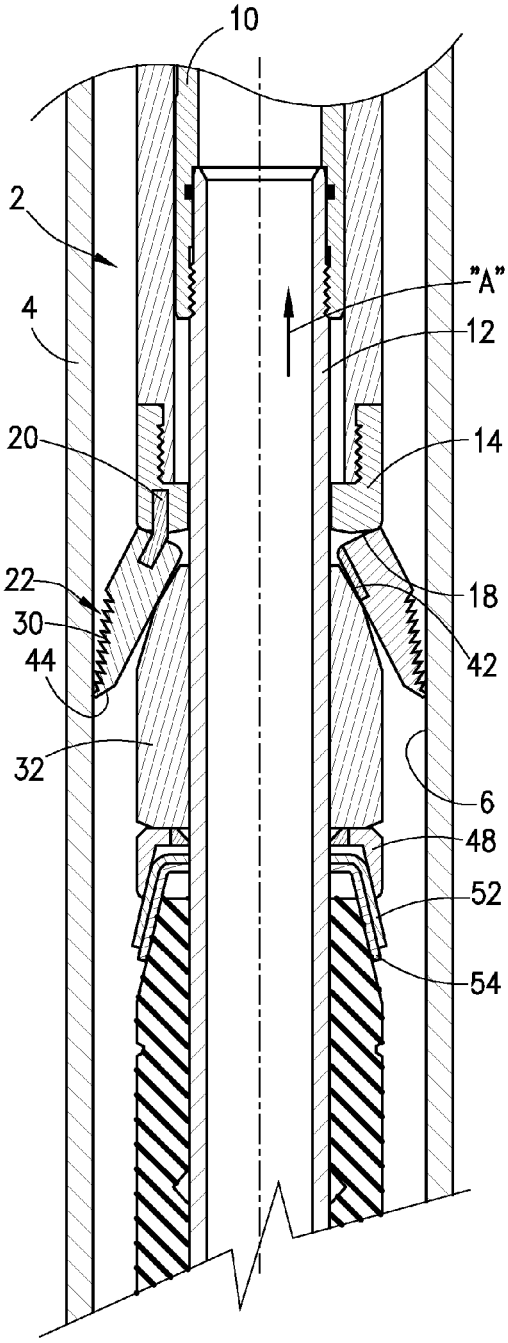
FIGS. 3A and 3B depict the sequential embodiment of the apparatus seen in FIGS. 2A and 2B with the lower slips partially controlled open.
Figure 3B:
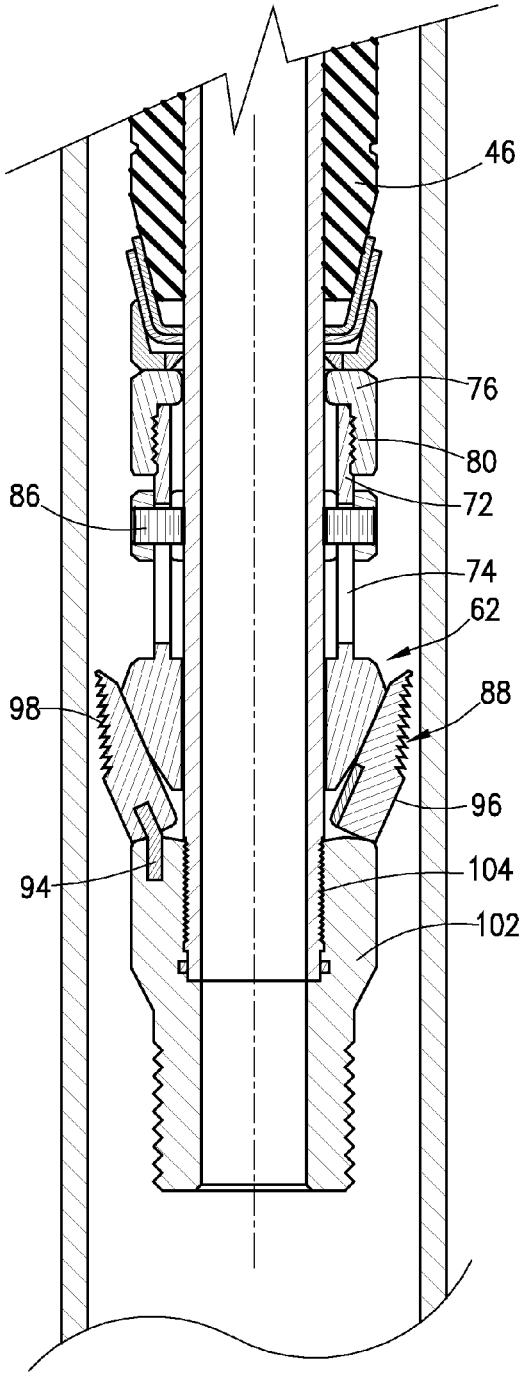

FIGS. 3A and 3B depict the sequential embodiment of the apparatus seen in FIGS. 2A and 2B with the lower slips 88 partially controlled open. The lower slips 88 are opening due to the lower cone means 62 wedging underneath the slips 88, as the mandrel 12 moves upward. Also, the shear pin 86 disposed within longitudinal slot 74 has moved relative to the lower cone means 62 (shear pin 86 is attached to mandrel 12). At this point, the tapered surface 98 does not touch the inner diameter portion 6.

Figure 4A:
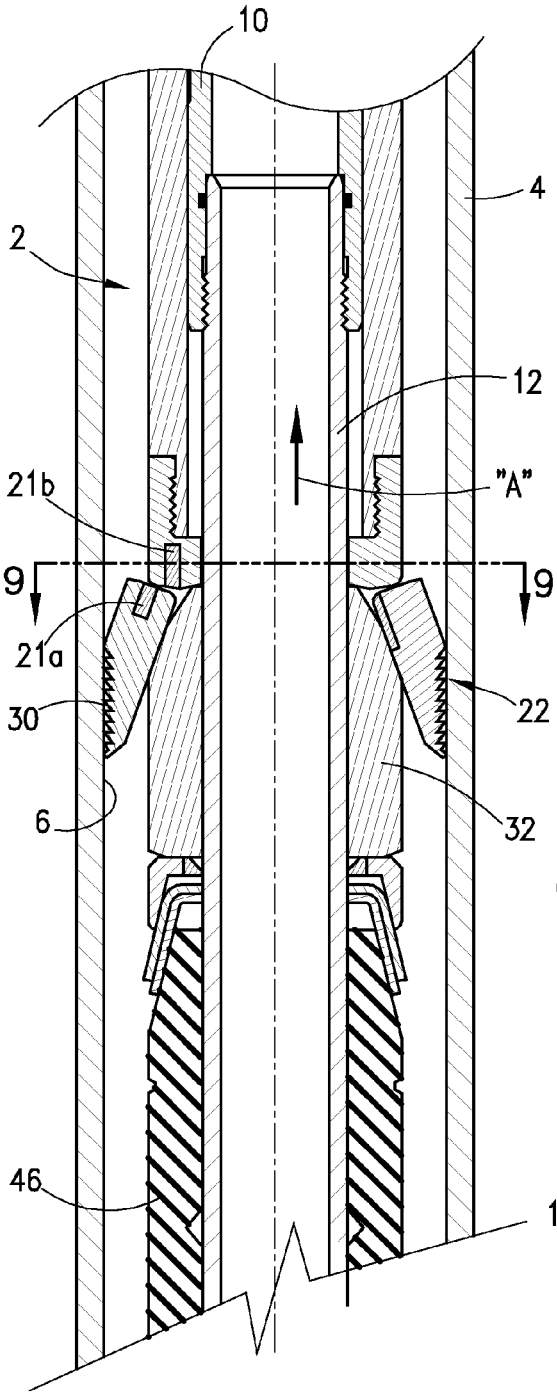
FIG. 4 is the sequential embodiment of the apparatus seen in FIGS. 3A and 3B with the upper slips controlled open and upper alignment pins sheared.
Figure 4B:
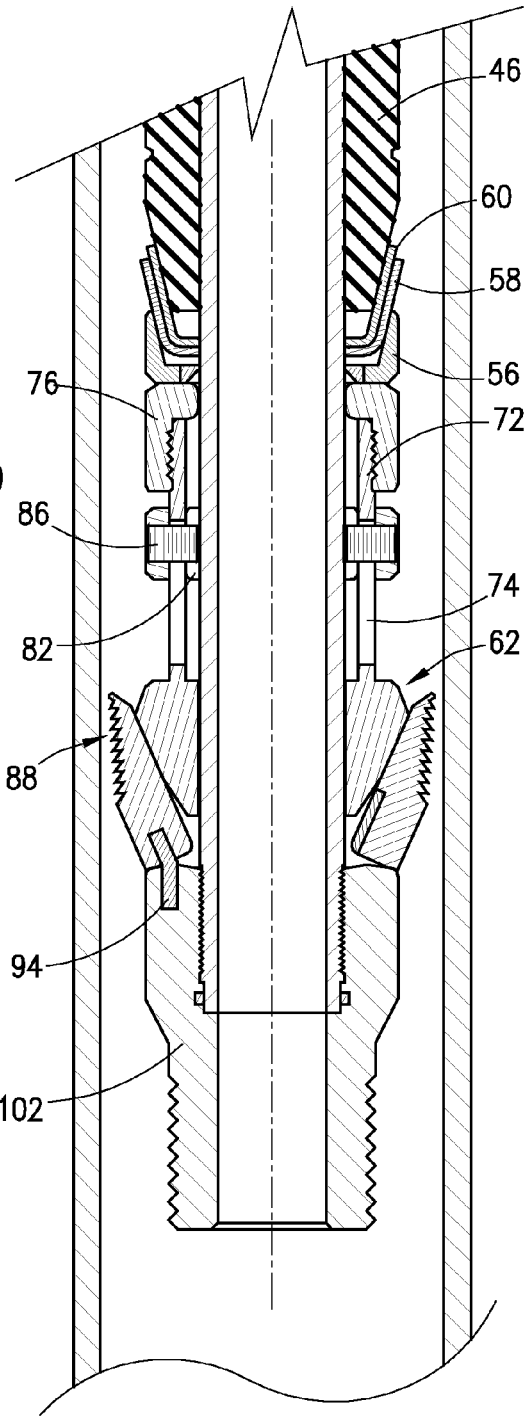

Referring now to FIGS. 4A and 4B, the sequential embodiment of the apparatus seen in FIGS. 3A and 3B with the upper slips 22 controlled open and alignment pins sheared into segments 21*a*, 21*b* is shown. Note that the tapered surface 30 engages the inner diameter portion 6.

Figure 5:
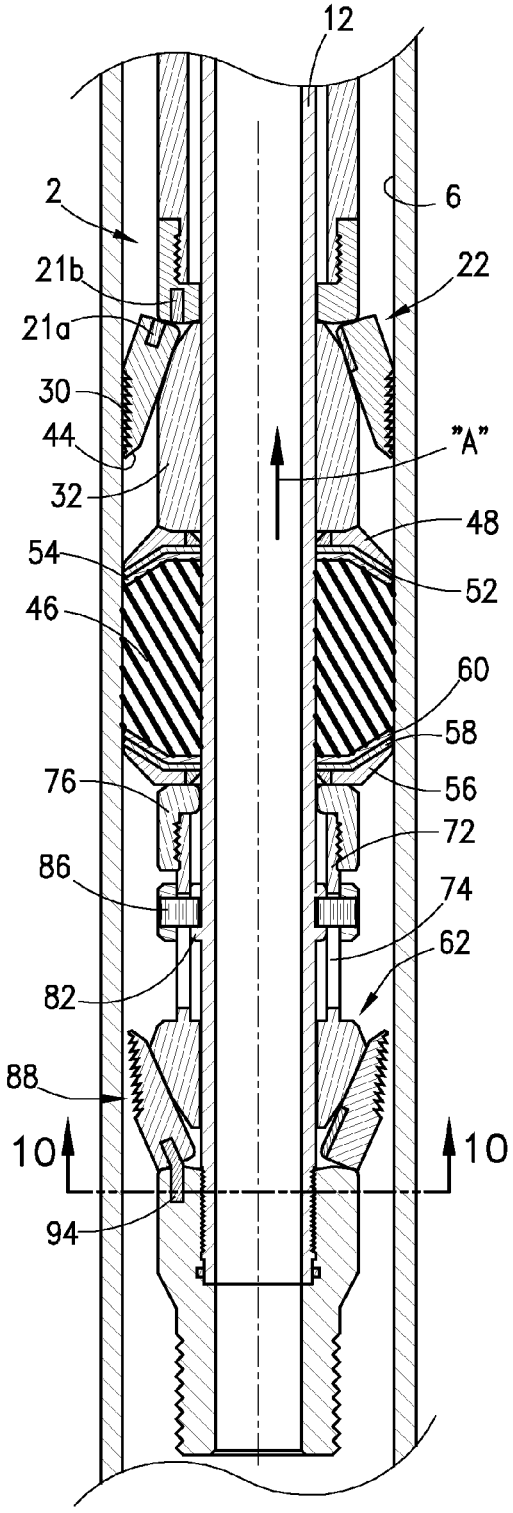
FIG. 5 is the sequential embodiment of the apparatus seen in FIGS. 4A and 4B with the lower slips in the partially controlled open mode with the sealing element compressed.

Referring now to FIG. 5, a sequential embodiment of the apparatus 2 seen in FIGS. 4A and 413 is shown, and wherein the lower slip device 88 is shown in the partially controlled open mode with the sealing element 46 compressed. Therefore, in this sequence illustration, the tapered surface 30 of the upper slip device 22 is shown engaged with the inner diameter portion 6. The setting tool means 8, as previously noted, continues the force on the mandrel 12 so that the mandrel 12 continues its movement in the direction shown by arrow "A". The lower cone means 62 will begin to wedge on the underside of the lower slip device 88 which will partially deploy the lower slip device 88 as seen in FIG. 5. Note that in FIG. 5, the radial teeth of the lower slip device 88 have not engaged the internal diameter portion 6. The mandrel 12 is connected to the lower cone leg member 72 via pin 86 so that the continued force on the mandrel 12 will cause the movement of the sub member 76, which in turn compresses the elastomeric member 46 against the inner diameter portion 6. However, the lower cone means 62 is prevented from fully wedging the lower slip device 88 outward. As per the teachings of this disclosure, limiting the lower slips 88 to partially open reduces drag, allowing the element to be fully compressed. In this way, the elastomeric member 46 can become fully compressed which ensures an adequate seal with the inner diameter portion 6. It should also be noted that cups 48, 52 and 54 have also been expanded, as well as cups 56, 58 and 60.

Figure 6:
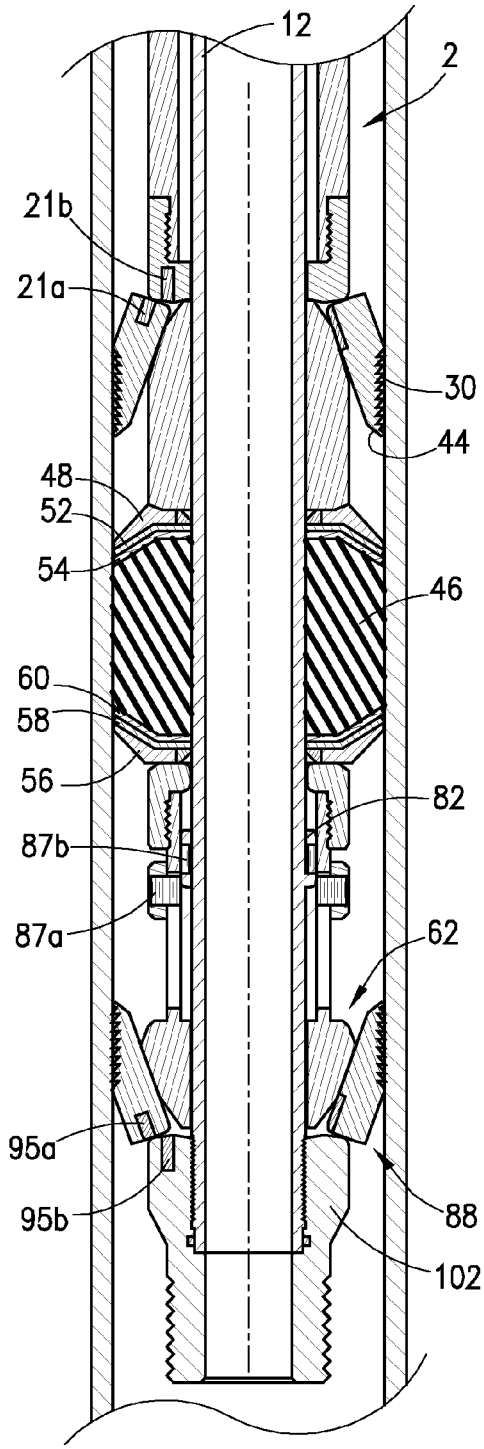
FIG. 6 is the sequential embodiment of the apparatus seen in FIG. 5 with the lower slips in the controlled full open element mode with the sealing element compressed, the stroke limiter sheared, and lower alignment pin sheared.

FIG. 6 is the sequential embodiment of the apparatus 2 seen in FIG. 5, wherein the lower slip device 88 is in the controlled full open element mode, and the elastomeric member 46 is compressed and the stroke limiter sheared (i.e. pin 86 has sheared). More specifically, the continued upward force on the mandrel 12 will cause the shear pin 86 to shear into segments 87*a*, 87*b* at a predetermined shear force thereby further lifting the lower member 102 which in turn drives the lower slip device 88 outward due to the back side of the lower slip device 88 wedging against the lower cone means 62.

The shear pin 94 is shown sheared into segments 95*a* and 95*b*. The curved radial surfaces 92, 106 aids in allowing the rocking motion which provides a smoother, steady, and gradual force to be applied to the alignment pin 94. Also note the position of the raised portion 82 in FIG. 5 as compared to FIG. 6, which depicts the distance that the mandrel 12 was allowed to travel due to the shearing of the pin 86. In other words, by the shearing of the pin 86, the mandrel 12 was allowed to travel a distance sufficient to fully deploy the lower slip device 88.

Figure 7:
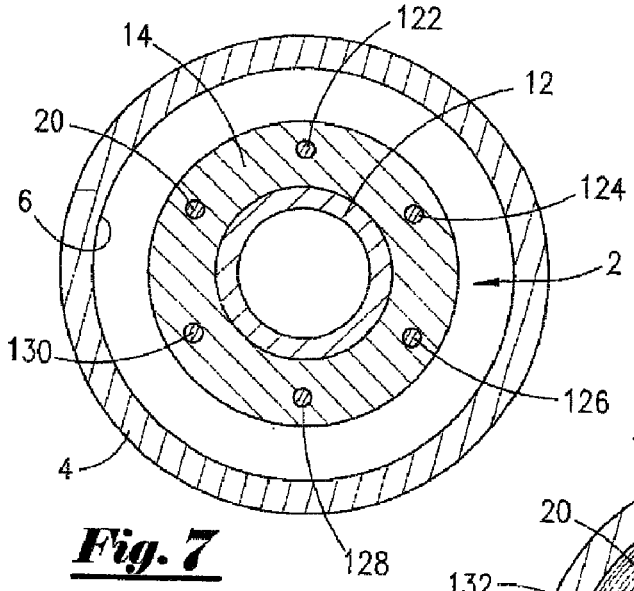
FIG. 7 is a cross-sectional view of the apparatus taken along line 7-7 in FIG. 1B.

Referring now to FIG. 7, a cross-sectional view of the apparatus 2 taken along line 7-7 in FIG. 1B will now be described. In this view, the inner mandrel 12 is concentrically disposed within the sub 14, and wherein the apparatus is concentrically disposed within the well 4 as previously described. The alignment pin 20 is shown, and as noted earlier, the alignment pin 20 aligns and connects the sub 14 to the upper slip device 22 (not seen in this view). FIG. 7 shows that several alignment pins are included, namely alignment pins 122, 124, 126, 128, 130, and wherein the plurality of equally spaced alignment pins ensures fracturing of the slip into equally spaced segments.

Figure 8:
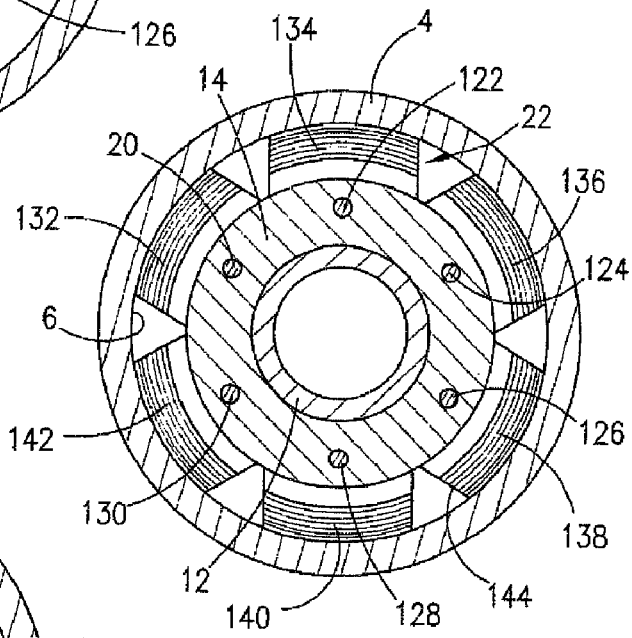
FIG. 8 is a cross-sectional view of the apparatus taken along line 8-8 in FIG. 2A.

FIG. 8 is a cross-sectional view of the apparatus 2 taken along line 8-8 in FIG. 2A. This view depicts the upper slip device 22 in the controlled open mode. As noted earlier, upper slip device 22 will fracture along the longitudinal cut lines, and wherein the upper slip device 22 will fracture into relatively equal segments, namely segments 132, 134, 136, 138, 140, 142 due to placement of the alignment pins. The radial teeth of the slip device is shown, for instance the radial teeth 144.

Figure 9:
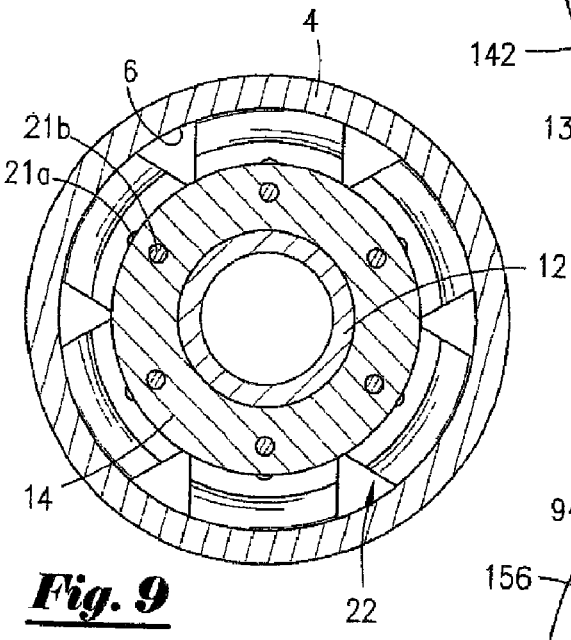
FIG. 9 is a cross-sectional view of the apparatus taken along line 9-9 in FIG. 4.

Referring now to FIG. 9, a cross-sectional view of the apparatus 2 taken along line 9-9 in FIG. 4A will now be described. In this view, the radial teeth of the upper slip device 22 are engaged with the inner diameter portion 6, and therefore, the teeth can not be seen from this view. Also, the alignment pins are sheared. Therefore, in FIG. 9, the shear pin part 21*b* is shown along with the shear pin part 21*a*. The tapered slips are fully opened and phased evenly.

Figure 10:
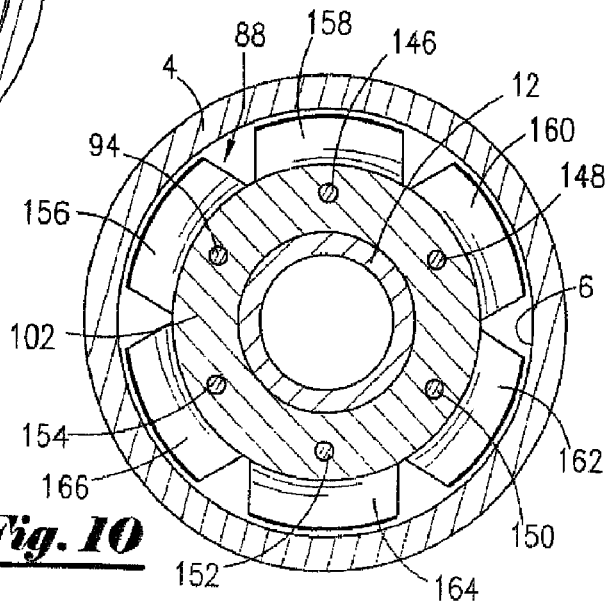
FIG. 10 is a cross-sectional view of the apparatus taken along line 10-10 in FIG. 5.

FIG. 10 is a cross-sectional view of the apparatus 2 taken along line 10-10 in FIG. 5. More specifically, the mandrel 12 is concentrically disposed within the lower member 102. The alignment pins 94, 146, 148, 150, 152, 154 are in place and have not been sheared yet, and wherein the plurality of equally spaced alignment pins ensures fracturing of the slip into equally spaced segments. In other words, the alignment pins control phasing of the tapered slips so when opening, they go out evenly. The lower slip device 88 is similar to the tipper slip device 22 in that it is comprised of a generally cylindrical member with radial teeth on the outer portion. As shown in FIG. 10, the upper slip device 22 will fracture into essentially equal segments during the setting process, namely slip segments 156, 158, 160, 162, 164, 166.

Figure 11:
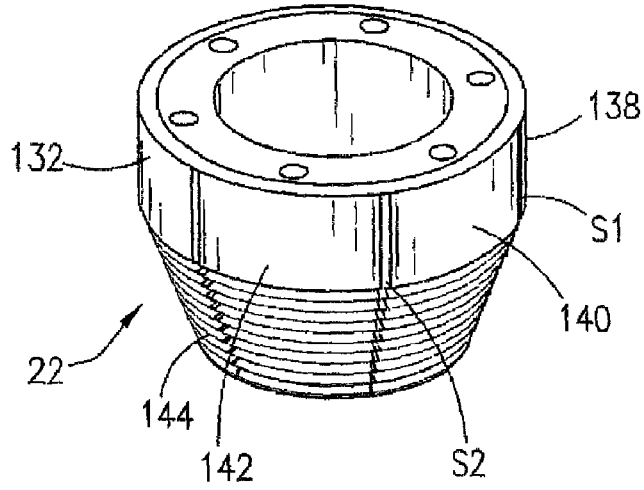
FIG. 11 is a perspective view of the upper slip device of the present disclosure.
Figure 12:
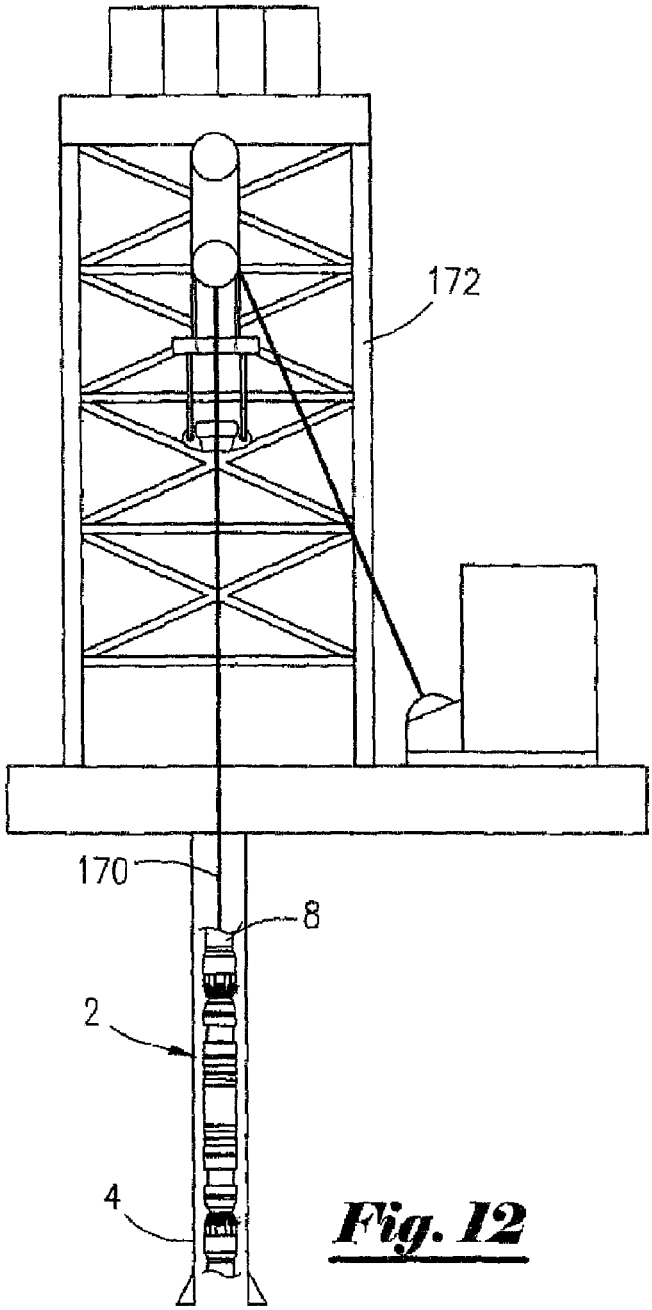
FIG. 12 is a schematic illustration of the apparatus of the present disclosure positioned within a well on wireline.

Referring now to FIG. 11, a perspective view of the upper slip device 22 will now be described. FIG. 11 depicts the longitudinal slots S1 and S2 that are provided to aid in providing equally fractured segments upon deployment, as previously noted. The radial teeth 144 are also shown. FIG. 12 is a schematic illustration of the apparatus 2 of the present disclosure positioned within the well 4 on wireline 170, and wherein the wireline 170 is suspended from the derrick 172 of a rig. As previously noted, the setting tool means 8 can be activated in order to set the apparatus 2 within the well 2 in accordance with the teachings of the present disclosure.

Because many varying and different embodiments may be made within the scope of the inventive concept herein taught, and because many modifications may be made in the embodiments herein detailed in accordance with the descriptive requirement of the law, it is to be understood that the details herein are to interpreted as illustrative and not in a limiting sense.

We claim:

1. A downhole tool for use in a well comprising:

a mandrel, wherein said mandrel contains a radial shoulder;

a first sub member concentrically disposed about said mandrel;

an upper slip concentrically disposed about said mandrel and positioned directly adjacent thereto, said upper slip having a series of grooves formed thereon;

an upper cone means abutting an underside of said upper slip, said upper cone means disposed about said mandrel and positioned directly adjacent thereto;

an elastomeric member operatively associated with said upper cone means, and wherein said elastomeric member is disposed about said mandrel and positioned directly adjacent thereto;

a lower slip concentrically disposed about said mandrel and positioned directly adjacent thereto, said lower slip having a series of grooves formed thereon;

a lower cone means abutting an underside of said lower slip, said lower cone means disposed about said mandrel and positioned directly adjacent thereto, and wherein said lower cone means is operatively associated with said elastomeric member;

a first plurality of alignment pins selectively connecting said first sub member with said upper slip, wherein said first plurality of alignment pins are selected to shear at a first predetermined force.

2. The downhole tool according to claim 1 further comprising a stroke limiter means, selectively attached to said mandrel, for allowing a predetermined amount of force to be transferred to said elastomeric member.

3. The downhole tool according to claim 1 wherein said upper slip has a first tapered angle on a first end.

4. The downhole tool according to claim 3 wherein said lower slip has a second tapered angle on a second end.

5. The downhole tool according to claim 4 wherein the first and second tapered angle is between 10 degrees and 45 degrees.

6. The downhole tool according to claim 1 further comprising a second plurality of alignment pins selectively connecting said radial shoulder with said lower slip, wherein said second plurality of alignment pins are selected to shear at a second predetermined force.

7. The downhole tool according to claim 6 further comprising a setting tool means for imparting a force in a first direction that is transmitted to said mandrel so that said upper cone means travels in the first direction, which in turn causes said radial shoulder to travel in a first direction which in turn expands said upper slip.

8. The apparatus of claim 6 wherein said mandrel includes a lower member and said lower member contains said radial shoulder, said radial shoulder having a radial face abutting said lower slip, said radial face having a curved surface to assist in a rocking movement thereby providing a gradual force to be applied to said second plurality of alignment pins.

9. The apparatus according to claim 1 wherein said first sub member includes a radial face abutting said upper slip, said radial face having a curved surface to assist in a rocking movement thereby providing a gradual force to be applied to said first plurality of alignment pins.

10. The apparatus according to claim 1 further comprising a first control cup assembly including a plurality of control cups disposed about said mandrel in an overlapping arrangement to engage a first end of said elastomeric member.

11. The apparatus according to claim 10, wherein said plurality of control cups are formed of a material that is sufficiently flexible to deform when actuated by said first end of said elastomeric member to control and guide an expansion of said elastomeric member.

12. The apparatus according to claim 11 further comprising a second control cup assembly including a plurality of control cups disposed about said mandrel in an overlapping arrangement to engage a second end of said elastomeric member.

13. The apparatus according to claim 12, wherein said plurality of control cups are formed of a material that is sufficiently flexible to deform when actuated by said second end of said elastomeric member to control and guide an expansion of said elastomeric member.

14. A downhole tool for use in a well comprising:

a mandrel containing a radial shoulder;

a first sub member concentrically disposed about said mandrel;

an upper slip, concentrically disposed about said mandrel and positioned directly adjacent thereto, for engaging with an internal portion of said well;

an upper cone means abutting an underside of said upper slip, said upper cone means disposed about said mandrel and positioned directly adjacent thereto;

an elastomeric member operatively associated with said upper cone means, and wherein said elastomeric member is disposed about said mandrel and positioned directly adjacent thereto;

a lower slip, concentrically disposed about said mandrel and positioned directly adjacent thereto, for engaging the with the internal portion of said well;

a lower cone means abutting an underside of said lower slip, said lower cone means disposed about said mandrel and positioned directly adjacent thereto, and wherein said lower cone means is operatively associated with said elastomeric member;

a first alignment member selectively connecting said first sub member with said upper slip, wherein said first alignment member is selected to shear at a first predetermined force.

15. The downhole tool according to claim 14 further comprising a stroke limiter means, selectively attached to said mandrel, for allowing a predetermined amount of force to be transferred to said elastomeric member.

16. The downhole tool according to claim 14 wherein said upper slip comprises a plurality of radial teeth and a series of longitudinal grooves formed thereon.

17. The downhole tool according to claim 16 wherein said lower slip comprises a plurality of radial teeth and a series of longitudinal grooves formed thereon.

18. The downhole tool according to claim 17 wherein said upper slip has a first tapered angle on a first end.

19. The downhole tool according to claim 18 wherein said lower slip has a second tapered angle on a second end.

20. The downhole tool according to claim 19 further comprising a second alignment member selectively connecting said radial shoulder with said lower slip, wherein said second alignment member is selected to shear at a second predetermined force.

21. The downhole tool according to claim 20 further comprising a setting tool means for imparting a force in a first direction that is transmitted to said mandrel so that said upper cone means travels in the first direction, which in turn causes said radial shoulder to travel in a first direction which in turn expands said upper slip.

22. The downhole tool according to claim 20 wherein the first and second tapered angle is between 10 degrees and 45 degrees.

23. The downhole tool according to claim 22 wherein said first and second alignment member is a pin having a predetermined shear value.

24. A method of setting a packer in a well comprising the steps of:

(a) providing the packer on a work string in the well, wherein said packer comprises: a mandrel having a radial shoulder; an upper slip, concentrically disposed about said mandrel and positioned directly adjacent thereto, for engaging with an internal portion of said well; an upper cone abutting an underside of said upper slip, said upper cone disposed about said mandrel and positioned directly adjacent thereto; an elastomeric member operatively associated with said upper cone, and wherein said elastomeric member is disposed about said mandrel and positioned directly adjacent thereto; a lower slip, concentrically disposed about said mandrel and positioned directly adjacent thereto, for engaging with the internal portion of said well; a lower cone abutting an underside of said lower slip, said lower cone disposed about said mandrel and positioned directly adjacent thereto, and wherein said lower cone is operatively associated with said elastomeric member; a first alignment member selectively connecting a sub member with said upper slip, wherein said first alignment member is selected to shear at a first predetermined force; and a stroke limiter means, selectively attached to said mandrel, for allowing a predetermined amount of force to be applied to said elastomeric member;

(b) moving the mandrel in a first direction;

(c) engaging the upper cone against said underside of the upper slip;

(d) fracturing the upper slip along a series of longitudinal grooves within said upper slip;

(e) opening said upper slip in a controlled mode;

(f) opening said lower slip in a controlled mode;

(g) shearing said first alignment member;

(h) anchoring said upper slip against the internal portion of the well;

(i) compressing said elastomeric member so that said elastomeric member engages the internal portion of said well;

(j) shearing a shear pin in said stroke limiter means;

(k) anchoring said lower slip against the internal portion of the well.

25. The method according to claim 24 wherein the upper and lower slips contain tapered angles so that in deployment a set of teeth of said upper and lower slips engage the internal portion of the well only upon full engagement with the upper and lower cone.

26. The method according to claim 25 wherein said first alignment member is a plurality of pins having predetermined shear values.

27. A method of setting a packer in a well comprising the steps of:

(a) providing the packer on a work string in the well, wherein said packer comprises: a mandrel having a radial shoulder; an upper slip, concentrically disposed about said mandrel and positioned directly adjacent thereto, for engaging with an internal portion of said well; an upper cone abutting an underside of said upper slip, said upper cone disposed about said mandrel and positioned directly adjacent thereto; an elastomeric member operatively associated with said upper cone, and wherein said elastomeric member is disposed about said mandrel and positioned directly adjacent thereto; a lower slip, concentrically disposed about said mandrel and positioned directly adjacent thereto, for engaging with the internal portion of said well; a lower cone abutting an underside of said lower slip, said lower cone disposed about said mandrel and positioned directly adjacent thereto, and wherein said lower cone is operatively associated with said elastomeric member; and a first alignment member selectively connecting a sub member with said upper slip, wherein the sub member is disposed about the mandrel, wherein said first alignment member is selected to shear at a first predetermined force;

(b) moving the mandrel in a first direction;

(c) engaging the upper cone against said underside of the upper slip;

(d) fracturing the upper slip along a series of longitudinal grooves within said upper slip;

(e) opening said upper slip in a controlled mode;

(f) opening said lower slip in a controlled mode;

(g) shearing said first alignment member;

(h) anchoring said upper slip against the internal portion of the well;

(i) compressing said elastomeric member so that said elastomeric member engages the internal portion of said well; and (j) anchoring said lower slip against the internal portion of the well.

28. The method according to claim 27 wherein the upper and lower slips contain tapered angles so that in deployment a set of teeth of said upper and lower slips engage the internal portion of the well only upon full engagement with the upper and lower cone.

29. The method according to claim 28 wherein said first alignment member is a plurality of pins having predetermined shear values.

* * * * *